US005209379A

United States Patent [19]

Dahlin

[11] Patent Number: 5,209,379

[45] Date of Patent: May 11, 1993

[54] METHOD OF ASSEMBLING A PRESSURIZED DISPENSER AND A PRESSURIZED DISPENSER FOR CARRYING OUT SAID METHOD

[75] Inventor: Arne S. Dahlin, Ludvika, Sweden

[73] Assignee: Inter Airspray Sweden Aktiebolag, Stockholm, Sweden

[21] Appl. No.: 689,239

[22] PCT Filed: Nov. 30, 1989

[86] PCT No.: PCT/SE89/00704

§ 371 Date: Jun. 11, 1991

§ 102(e) Date: Jun. 11, 1991

[87] PCT Pub. No.: WO90/06814

PCT Pub. Date: Jun. 28, 1990

[30] Foreign Application Priority Data

Dec. 15, 1988 [SE] Sweden ..... 8804531

[51] Int. Cl.[5] ..... B65D 83/14

[52] U.S. Cl. ..... 222/401; 29/450; 222/369; 222/402.1; 264/242

[58] Field of Search ..... 222/394, 396, 401, 402, 222/402.1; 239/333; 264/242, 295, 339; 29/450, 451

[56] References Cited

U.S. PATENT DOCUMENTS

| | | | |
|---|---|---|---|
| 3,955,720 | 5/1976 | Malone | 222/401 X |
| 4,093,108 | 6/1978 | Hein et al. | 222/401 |
| 4,341,330 | 7/1982 | Mascia et al. | 222/402.1 X |

FOREIGN PATENT DOCUMENTS

| | | | |
|---|---|---|---|
| 0037035 | 10/1981 | European Pat. Off. . | |
| 0075224 | 3/1983 | European Pat. Off. . | |
| 2356907 | 1/1980 | Fed. Rep. of Germany . | |
| 8102459 | 9/1981 | World Int. Prop. O. | 29/450 |

*Primary Examiner*—Andres Kashnikow
*Assistant Examiner*—Joseph A. Kaufman
*Attorney, Agent, or Firm*—Young & Thompson

[57] ABSTRACT

A pump spray dispenser with an inner cylindrical tube (2) in the container portion (1) and a piston mounted on the handle (6) is provided with inwardly directed projections (14) about the mouth of the cylindrical tube. During the assembly process, the container parts with tubular cylinders are slipped onto upright mandrels fixed to a conveyor belt or the like. Each mandrel bends the projections towards the interior end of the cylindrical tube and when the container portion is removed from the mandrel, the projections begin recovery towards their original shapes sufficiently slowly to enable the piston to be inserted past the projections without damaging the piston. The projections then return to a still bent position in contact with the piston stem (4) to center and retain the piston assembly.

6 Claims, 1 Drawing Sheet

METHOD OF ASSEMBLING A PRESSURIZED DISPENSER AND A PRESSURIZED DISPENSER FOR CARRYING OUT SAID METHOD

1. FIELD OF THE INVENTION

The present invention relates to a method of assembling a pressurized or spray dispenser provided with a pump device for pressurizing the interior of the dispenser, said dispenser comprising, firstly, a liquid container of plastic or similar material with a cylindrical pump tube integral therewith and, secondly, a handle provided with a piston which is mounted on a piston stem and is displaceable in the cylindrical tube, said piston having an abutment surface for determining the outer end position of the piston. The present invention also relates to a pressurized dispenser for carrying out said method.

2. BACKGROUND OF THE INVENTION

It has been a goal in recent years to replace the previously used propellent gas freon in pressurized spray dispensers with other propellents which are less detrimental to the environment. One obvious alternative is to pressurize the dispenser container with ambient air by means of a pump built into the dispenser. Such spray dispensers are previously known and are generally made of plastic material. In order for the pump device to function throughout the entire life of the dispenser, the piston stem must be centered and prevented from lateral movement by a relatively hard and wear resistant plastic bushing or retainer ring. Canadian patent specification No. 1 004 641 describes such a bushing or retaining ring which fulfills the functions just mentioned. This known element has, however, the disadvantage that it is separate from the container and requires mounting on the piston stem between the piston and the handle. It is impossible to force the piston through the bushing or retaining ring without destroying the sealing surfaces of the piston.

SUMMARY OF THE INVENTION

The purpose of the present invention is to achieve a pump spray dispenser and a method of assembling the components of such a dispenser which are much simpler and cheaper than what was known up to now without sacrificing the requirement of rigid centering and guiding of the piston stem in the cylinder tube. This is achieved by a method of the type described by way of introduction which is characterized in that prior to assembly, a mandrel is inserted into the cylindrical tube thereby bending towards the interior end of the cylindrical tube a plurality of projections arranged on the inner surface of the cylindrical tube and directed substantially towards the central axis of the tube, whereafter the mandrel is removed and the piston on the piston stem is inserted into the cylindrical tube, whereafter the projections resiliently recover until they are in contact with the piston stem to center the same and determine together with the abutment surface the outer end position of the piston. A pressurized or spray dispenser for carrying out the method comprising a liquid container of plastic or similar material with a cylindrical pump tube integral therewith and a handle provided with a piston mounted on a piston stem and displaceable in the cylindrical tube, said piston having an abutment surface for determining the outer end position of the piston, is characterized in that a plurality of projections directed substantially towards the central axis of the tube are arranged on the interior surface of the cylindrical tube, said projections being bendable towards the interior end of the cylindrical tube and having a resilient recovery towards their original position which is sufficiently slow to permit the insertion of the piston past the projections which are still bent towards the interior end of the cylindrical tube without damaging the piston.

BRIEF DESCRIPTION OF THE DRAWINGS

In order to facilitate understanding of the invention, the method and the dispenser for carrying out the method will be described with reference to a number of drawings, of which.

DETAILED DESCRIPTION OF THE INVENTION

Figure 1:
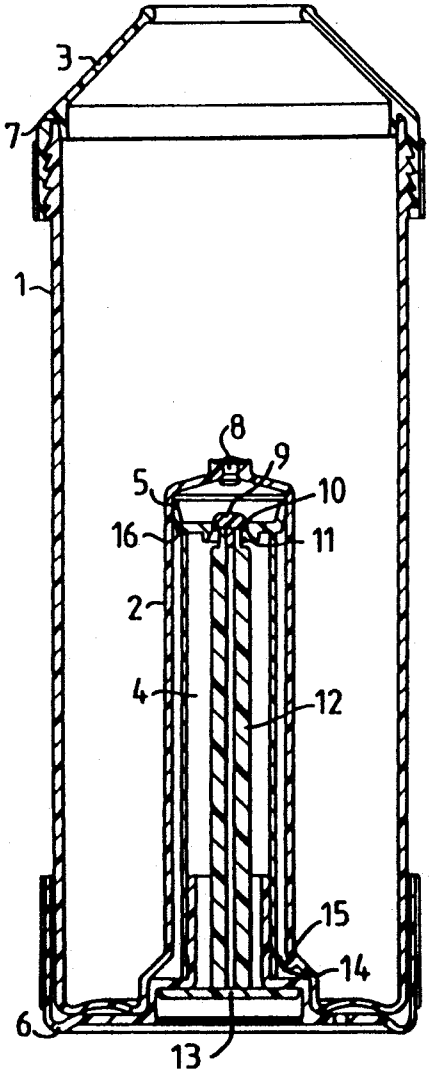
FIG. 1 shows in longitudinal section an illustrating example of a spray dispenser according to the invention in its assembled state.

FIG. 1 shows an assembled spray dispenser provided with a pump device used to pressurize the interior of the dispenser with ambient air. The dispenser consists of a container 1 under which a cover 3 has been screwed. The cover must also be provided with a finger actuated valve (not shown) which is arranged in the central opening thereof. The cover is provided with a threaded portion and a groove in the bottom of which an O-ring 7 is disposed. When screwed tightly unto the threaded portion of the container 1, the cover 3 establishes a pressure tight seal with the container 1.

The container 1 for the pressurized liquid is made integral with an inner coaxial cylindrical tube 2 (see also FIG. 2), at the upper end of which there is a non-return pump valve 8 which permits air to flow from the interior of the cylindrical tube to the interior of the container. A piston assembly consisting of the piston 5, the piston stem 4 and a handle 6 attached thereto can be reciprocated in the cylindrical tube 2 to increase the pressure in the container prior to using the dispenser for spraying purposes. The piston 5 has a relatively soft edge which seals against the inner surface of the cylindrical tube 2 during the pressure stroke. The piston 5 is also provided with a non-return valve 9 which opens when the piston assembly is pulled downwards in the figure by means of the handle. The body of the valve 9 seals against the seat 10 in the piston during the pressure stroke so that air is forced into the container through the valve 8.

Should the pressure in the container become too high, which would in turn make the pressure between the piston 5 and the valve 8 excessive during the pressure stroke of the piston assembly, the valve body 9 will be forced past the valve seat 10 and into the hole 11, thus preventing an increase of pressure during the pressure stroke of the piston assembly. The valve body 9 is connected to an indicator plate 13 by means of a rod 12. When the safety function is triggered due to excessively high pressure in the container, the indicator plate is moved outwards to alert the user to the fact that the container is fully pressurized. When the spray valve (not shown) has been actuated for a period of time, the user can then depress the plate 13 to press the valve body 9 through the hole 11 and reestablish the original pumping function.

The outer end position of the piston assembly is determined by the piston shoulder 16 abutting against three projections 14 which are evenly distributed about the mouth of the cylindrical tube. These projections are integral with the cylinder tube and the container and consist of relatively hard and wear resistent plastic material, for example polypropylene. The piston, on the other hand, is made in a relatively soft plastic material, for example LD-polyethylene, in order to seal properly against the interior wall of the cylindrical tube.

Figure 2:
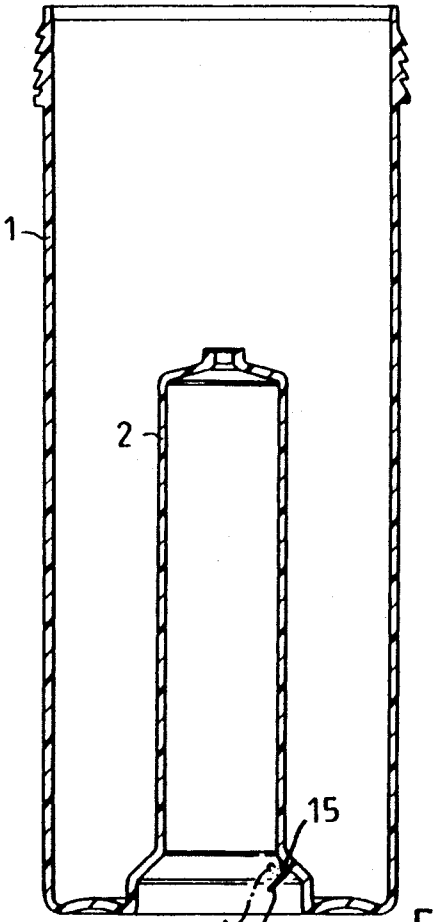
FIG. 2 shows in longitudinal section and in a somewhat larger scale the container with the cylindrical tube made integral therewith.

As was mentioned above, the container, the cylindrical tube and the projections are made in one piece and have the shape shown with solid lines in FIG. 2. According to one embodiment of the method according to the invention, a conveyor belt or the like is used with a row of upright mandrels securely mounted thereto. Each finished container 1 is pressed onto a mandrel, so that the mandrel is inserted into the cylindrical tube bending the projections 14 to a position 14' shown with dash dot lines. At the station for insertion of the piston assembly into the cylindrical tube, the container 1 is removed from the upright mandrel and the piston is then inserted into the cylindrical tube past the projections 14'. The projections 14, each provided with a reinforcing rib 15, have such a slow rate of recovery that the relatively soft and easily damaged piston 5 can be inserted past the projections before they return to contact with the piston stem to retain the piston assembly and determine, together with the shoulder 16 of the piston, the outer end position of the piston. This has been achieved according to the invention without requiring any separate bushing element which must somehow be mounted around the piston stem between the piston and the handle, a step which must necessarily complicate the manufacturing process and make it more expensive.

Figure 3:
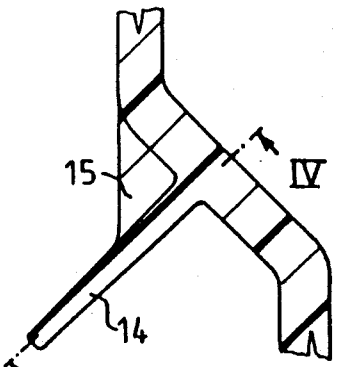
FIG. 3 shows on an even larger scale a detail of FIG. 2, i.e. a projection prior to insertion of the mandrel in the cylindrical tube.
Figure 4:
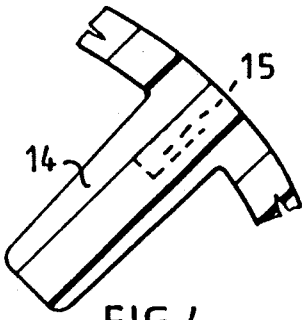
FIG. 4 is a section along the line IV—IV in FIG. 3.

Detail views in section from one side and from below are shown in FIG. 3 and 4, respectively, which both show a projection before the mandrel has been inserted into the cylindrical tube. As can be seen, the projection is provided with a reinforcing rib 15.

We have described here only one example of how the method according to the invention achieves a simplified and more reliable assembly of a spray dispenser without sacrificing the ability and reliability of operation. Within the scope of the attached claims, the person skilled in the art has a number of possibilities of varying the method of assembly and achieving the same result.

I claim:

1. A method of assembling a pressurized dispenser provided with a pump device for pressurizing the interior of the dispenser, said dispenser comprising a plastic container (1) with a cylindrical tube (2) integral therewith and a handle provided with a piston (5) which is mounted on a piston stem (4) and is displaceable in the cylindrical tube (2), said piston (5) having an abutment surface (16) for determining an outer end position of the piston, said method comprising: inserting a mandrel into the cylindrical tube (2) prior to assembly thereby bending towards the interior of the cylindrical tube a plurality of projections (14) arranged on the inner surface of the cylindrical tube and directed substantially towards the central axis of the tube, thereafter removing the mandrel and inserting the piston (5) mounted on said piston stem (4) into the cylindrical tube (2), whereby the projections resiliently recover until they are in contact with the piston stem (4) to center the same and determine together with the abutment surface (16) the outer end positions of the piston (5).

2. Method according to claim 1, wherein the mandrel is fixed in an upright position on a conveyor belt prior to insertion into said cylindrical tube.

3. Pressurized dispenser comprising: a plastic container (1) with a cylindrical tube (2) integral therewith and a handle (6) provided with a piston (5) mounted on a piston stem (4) and displaceable in the cylindrical tube (2), said piston (5) having an abutment surface (16) for determining an outer end position of the piston, a plurality of projections (14) directed substantially towards a central axis of the tube and arranged on the inner surface of the cylindrical tube, said projections being bendable towards the interior of the cylindrical tube and having a resilient recovery towards their original position which is sufficiently slow to permit the insertion of the piston (5) past the projections (14) while said projections are still bent towards the interior of the cylindrical tube, without damaging the piston.

4. Pressurized dispenser according to claim 3, wherein the projections (14) are three in number, and are evenly distributed in the same plane about the inner surface of the cylindrical tube.

5. Pressurized dispenser according to claim 3, wherein the container with the cylindrical tube and the projections is made in one piece in polypropylene plastic.

6. Pressurized dispenser according to claim 3, wherein the piston is made in LD-polyethylene plastic.

* * * * *